United States Patent [19]

Laing

[11] 3,996,477

[45] Dec. 7, 1976

[54] THERMAL PRIME MOVER

[76] Inventor: Nikolaus Laing, Hofener Weg 35-37, 7141 Aldingen near Stuttgart, Germany

[22] Filed: May 15, 1974

[21] Appl. No.: 470,060

[30] Foreign Application Priority Data

June 15, 1970 Austria ..... 5369/70
June 15, 1970 Austria ..... 5370/70

[52] U.S. Cl. ..... 290/52; 60/669
[51] Int. Cl.[2] ..... H02K 7/18
[58] Field of Search ..... 60/659, 669, 641; 122/11; 290/1 R, 52

[56] References Cited

UNITED STATES PATENTS

| | | | |
|---|---|---|---|
| 741,271 | 10/1903 | Porter et al. | 290/1 R |
| 778,707 | 12/1904 | Reichenbach | 290/1 R |
| 2,140,175 | 12/1938 | Starziczny | 60/669 |
| 2,362,151 | 11/1944 | Ostenberg | 290/1 R |
| 2,707,863 | 5/1955 | Rhodes | 60/669 |
| 2,968,916 | 1/1961 | Taylor et al. | 60/641 |
| 3,613,368 | 10/1971 | Doerner | 60/669 |

FOREIGN PATENTS OR APPLICATIONS

| | | | |
|---|---|---|---|
| 1,239,342 | 7/1960 | France | 60/669 |

*Primary Examiner*—Martin P. Schwadron
*Assistant Examiner*—H. Burks, Sr.
*Attorney, Agent, or Firm*—Karl F. Ross; Herbert Dubno

[57] ABSTRACT

A power plant, e.g. for an automotive vehicle, comprises a rotary heat exchanger and an engine mounted coaxially therewith on a stationary support, the engine having two relatively rotatable members (e.g. a turbine rotor and a turbine stator) driven in opposite directions by the vapor pressure of a working fluid passing in a closed circuit through an evaporator section of the heat exchanger, the engine housing, and a condenser section of the heat exchanger. One of the counterrotating members, generally the stator, is rigid with the housing whereas the other one is operatively coupled with a load, e.g. by magnetic flux traversing a magnetically pervious wall of the housing. The coupling may include an armature winding of an electric-current generator disposed outside the engine housing for excitation by one or more magnets carried by the rotor inside the housing. With a suitable step-down ratio between the load and the rotor, the latter may turn at a speed substantially higher than that of the stator.

10 Claims, 4 Drawing Figures

THERMAL PRIME MOVER

REFERENCE TO RELATED APPLICATIONS

This application is a continuation-in-part of my copending application Ser. No. 383,537 filed July 30, 1973 as a continuation of my prior application Ser. No. 152,946 which was filed on June 14, 1971 and is now abandoned. The present application also discloses subject matter of my copending application Ser. No. 396,520 filed Sept. 12, 1973, now U.S. Pat. No. 3,877,515.

FIELD OF THE INVENTION

The present invention relates to a thermal power plant serving as a prime mover for a load such as the traction wheels of an automotive vehicle. It has, however, more general utility in the field of converting thermal energy into motive power.

BACKGROUND OF THE INVENTION

The conventional internal-combustion engine, used heretofore almost exclusively in automotive vehicles, is one of the major contributors to the pollution of the environment, especially in urban centers of high traffic density. This is due to the fact that the extremely brief ignition period does not allow complete combustion of the air/fuel mixture so that the exhaust gases are rich in toxic constituents such as carbon monoxide. Another drawback of such engines is the noise due to their intermittent mode of operation, particularly in the case of motors running close to their rated capacity. This problem is aggravated by the current tendency to lower fuel consumption through reduction of the power ratings of automotive engines.

OBJECTS OF THE INVENTION

An important object of my present invention is to provide a power plant of the external-combustion type avoiding the aforestated disadvantages of internal-combustion engines.

A related object is to provide means in such a power plant for operating same with optimal efficiency under widely varying load conditions.

Another object of my invention is to provide means for avoiding leakages of working fluid in an engine operating according to some variant of the Carnot cycle, such as the Rankine or the Stirling cycle, in which this fluid travels in a closed circuit through zones of different temperatures and pressures.

A more particular object of my invention is to provide means in a system of this type for storing a certain amount of kinetic energy so as to minimize power consumption under idling conditions while keeping the engine in readiness for quick acceleration.

SUMMARY OF THE INVENTION

These objects are realized, in conformity with my present invention, by the provision of an engine adapted to be driven by vapors of a vaporizable working fluid, e.g. a gas turbine, having two relatively rotatable members which will be referred to hereinafter as a stator and a rotor, respectively. One of these members, specifically the stator, is connected with a heat exchanger for joint rotation therewith, this heat exchanger including an evaporator upstream of the engine and a condenser downstream of the engine linked therewith by a conduit system for the conduction of a working fluid in a closed circuit through the evaporator, the engine housing and the condenser in this order. The other relatively rotatable member, i.e. the rotor, is operatively coupled to a load by suitable transmission means, preferably with a step-down ratio allowing the absolute speed of the rotor with reference to a stationary support to be substantially greater than that of the stator and of the heat exchanger jointly rotating therewith. This transmission may include a planetary-gear drive as conventionally used with automotive engines; alternatively, or in addition, the load speed can also be reduced with reference to the rotor speed by an electromagnetic coupling including one or more rotor-driven magnets within the engine housing and an armature winding of a current generator excitable by these magnets through a magnetically pervious housing wall.

Such an electromagnetic coupling enables the engine housing and the associated conduits to be hermetically sealed against the atmosphere. In principle, however, it will also be possible to dispose the entire current generator within the housing and to deliver its output to a load motor through slip rings, though such an arrangement is more complex. Alternatively, the coupling may be entirely magnetic, with permanent magnets or electromagnets disposed on one side and ferromagnetic pole pieces disposed on the other side of a permeable housing wall. In all these instances, a certain slip is present between the driving and the driven elements of the transmission which further increases the step-down ratio, thereby enabling the engine to operate in a speed range of optimum efficiency regardless of load speed.

The continuously rotating member referred to as the stator stores a certain amount of kinetic energy so as to require little acceleration in order to circulate a heating medium through the rotary evaporator and a cooling medium through the rotary condenser during idling of the engine, i.e. with the rotor thereof arrested by the load or by a brake. On the other hand, as the operator increases the supply of heating medium to the engine under load, a slowdown of the rotor due to increased loads (e.g. on uphill driving) exerts a larger reaction torque upon the stator and therefore upon the rotating heat exchanger which thus absorbs more thermal energy from that medium to accelerate the rotor. A self-stabilizing thermomechanical system is thereby created.

BRIEF DESCRIPTION OF THE DRAWING

The above and other features of my invention will now be described in detail with reference to the accompanying drawing in which.

SPECIFIC DESCRIPTION

Figure 1:
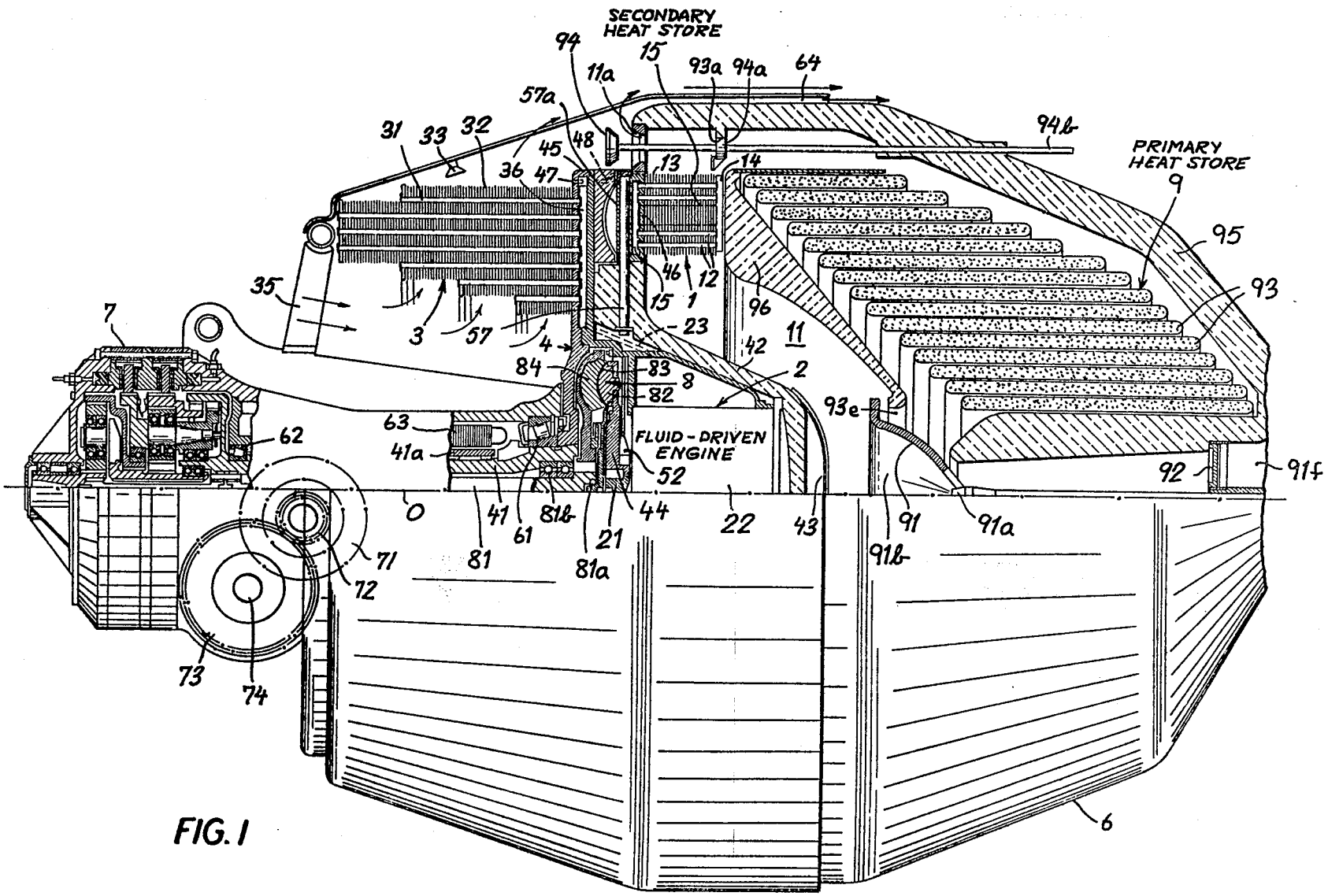
FIG. 1 is a side-elevational view, partly in axial section, of a power plant embodying my invention.
Figure 2:
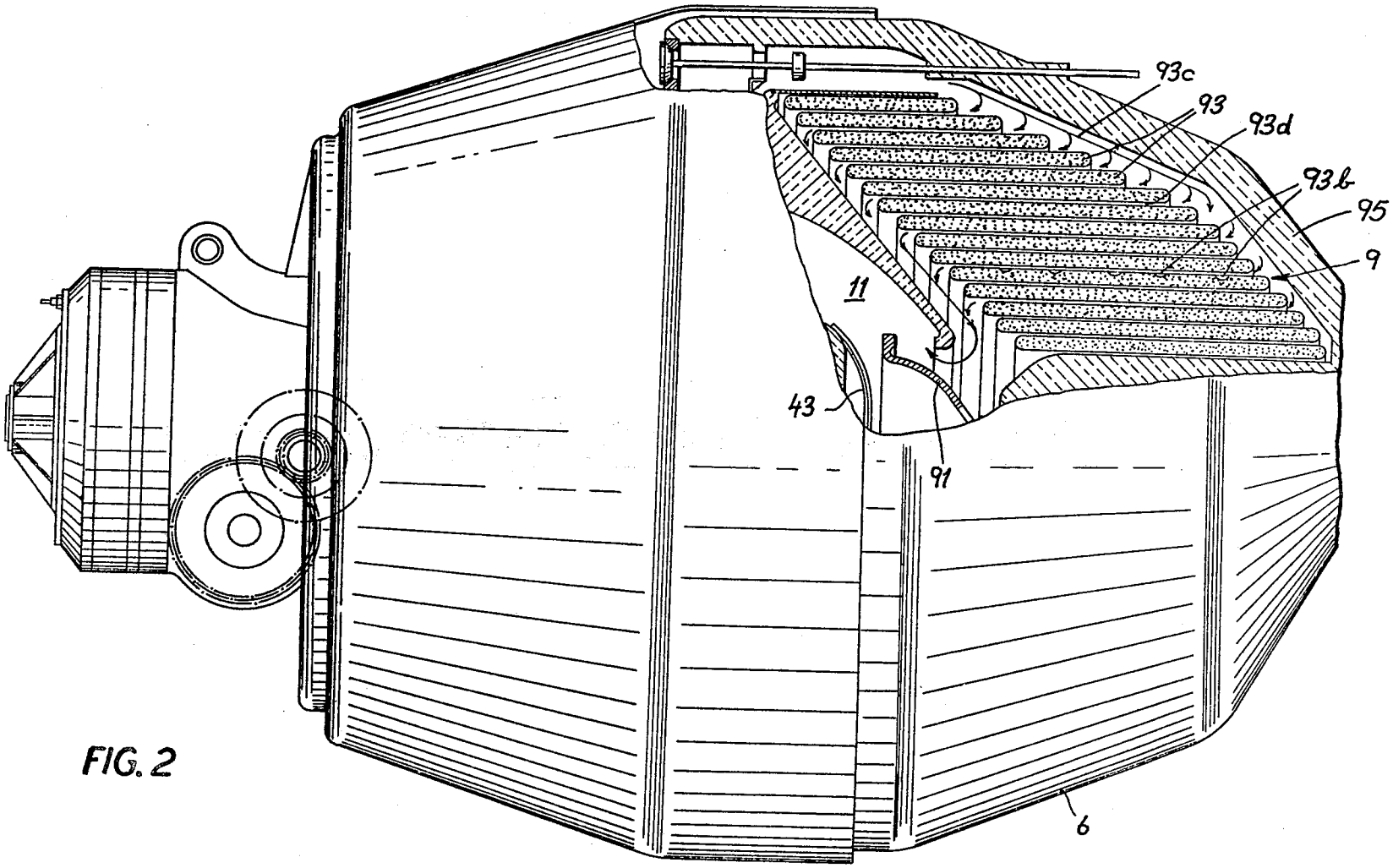
FIG. 2 is a view similar to FIG. 1, illustrating a different operating position.

In FIGS. 1 and 2, I have shown a power plant according to the invention comprising two rotary heat-exchanger sections 1 and 3 centered on a common axis 0, section 1 serving as an evaporator and section 3 serving as a condenser for a working fluid traveling in a closed circuit through the heat exchangers 1, 3 and through an engine 2 operated by fluid pressure. Component 2 may be a turbine, a Wankel motor or any other fluid-driven engine having a frame 22 and an output shaft 21, the latter being journaled in a transverse wall 44 of a housing 4 which is centered on axis 0 and has a tubular shaft 41 journaled via bearings 61, 62 in a stationary outer casing 6. An electromagnetic winding 63, mounted on shaft 41 through the intermediary of a ring 41*a*, forms part of a starting motor which can be energized at the beginning of operations to set the unit 1 – 4 in rotation about axis 0.

Housing 4 hermetically seals the flow path of the circulating working fluid against the atmosphere. This flow path includes a conduit 23 for spent vapor leaving the engine 2, the vapor passing into an annular manifold or header 36 behind a housing wall 47 which carries an annular array of axially extending tubes 31 forming part of the condenser 3; the tubes 31 communicate at one end with the manifold 36 and are closed at their other end. Condensate collecting in a trough at the periphery of the manifold 36 is fed by a pump 45 via a connection 48 to a similar manifold or header 16 behind an annular housing wall 46 from which an annular array of tubes 12, forming part of evaporator 1, extend in the opposite axial direction; these latter tubes communicate at one end with manifold 15 and are likewise closed at the opposite end. The fluidic circuit is completed by a nonillustrated conduit returning the expanding vapors to the engine 2 from the manifold 16.

The need for a condensate pump can be avoided through utilization of the thermosiphon principle if the connection 48 between the two heat exchangers is relocated from the periphery of the housing to the vicinity of its axis and if the outer radius of condenser 3 is made less than that of evaporator 1 so that the condensate leaving the tubes 31 is drawn radially inwardly against a centrifugal force less than that which propels the same condensate radially outwardly toward the tubes 12. Such a thermosiphon-type heat-exchanger assembly has been more fully described and illustrated in my copending application Ser. No. 286,569 filed Sept. 5, 1972 now U.S. Pat. No. 3,862,951.

The evaporator tubes 12 and the condenser tubes 31, consisting of highly heat-conductive metal, are interconnected by respective sets of annular ribs 13 and 32 of similar metal which are centered on the axis 0 and lie in transverse planes closely spaced from one another. Air or other gas present between these ribs is frictionally entrained around the axis so as to be subjected to a centrifugal force; the resulting radially outward flow drives the individual gas particles along trajectories in the form of Archimedean spirals. Thus, if the tubes are disposed along similar spiral curves, their presence does not give rise to any shear forces tending to retard or accelerate the flow. This conforms to the reactionless arrangement disclosed and claimed in my copending application Ser. No. 286,569 filed Sept. 5, 1972, now U.S. Pat. No. 3,877,515.

Furthermore, as also particularly illustrated for the condensing heat-exchanger section 3, the tubes may be staggered in length so that the radially innermost tubes terminate nearer their manifold or header than the outlying tubes. In conformity therewith, the radial width of the ribs decreases in the direction away from housing 4. This staggering exposes the more outlying tubes to a more immediate thermal interaction with the oncoming air flow. In order to provide a substantially uniform ratio of mass flow to effective surface area, the axial spacing of the ribs is preferably greatest in the vicinity of the housing 4, where their surface is largest, and progressively diminishes as the inner radii of the ribs increase. This arrangement has been disclosed and claimed in my copending application Ser. No. 84,097 filed Oct. 26, 1970 now U.S. Pat. No. 3,811,515.

The tubes and the ribs may consist of aluminum or an aluminum alloy, e.g. with a core containing 3% magnesium and with a lower-melting surface layer containing 10% magnesium to facilitate the soldering of the tubes to the ribs and to the housing 4.

Engine shaft 21 carries a rotor 82 which forms an annular array of magnetic poles confronting a similar array 84 on a drive shaft 81 whose end proximal to engine 2 is supported on motor shaft 21 through bearings 81*a* and is also journaled in shaft 41 via bearings 81*b*. The opposite end of shaft 81 is connected with a planetary-gear transmission 7 of conventional construction which, by way of a bevel gear 71 and spur gears 72, 73, drives a shaft 74 coupled (e.g. through a differential gearing) with the traction wheels of an automotive vehicle powered by the system of FIGS. 1 and 2.

The pole rings 82 and 84, of which at least one should be permanently magnetized, form part of a magnetic coupling generally designated 8. The magnetic flux interlinking these pole rings passes through a wall portion 83 of housing 4 which offers a low reluctance to the flux thereacross and which may therefore be described as magnetically pervious.

The stationary part of the assembly of FIGS. 1 and 2 comprises a primary heat store or accumulator of thermal energy 9 here shown to consist of a set of flat annular containers 93, centered on axis 0, which are filled with a fusible compound (e.g. lithium hydroxide) and which are held slightly separated, by means of nonillustrated spacers, to form passages 93*d* for a gaseous heat carrier such as air. The heat store 9 is enclosed by thermally insulating walls 95 and 96 which define an entrance port 93*a* and an annular exit gap 93*e*. The two passages 93*a* and 93*e* open into a generally bell-shaped channel 11 bounded by the insulating wall 96 and by a similar insulating layer 42 on housing 4; a central radiation reflector 43, mounted on the housing, confronts a burner head 91 to which a hydrocarbon fuel such as gasoline or Diesel oil is admitted via an axially disposed nozzle 91*a*. An air inlet 91*f* can be partially throttled or fully blocked by a valve 92. Most of the air passing the valve 92 enters a combustion chamber 91*b*, within burner head 91, and the adjoining space 11, around the nozzle 91*a*; a fraction of this air stream, which can be regulated by an axial shifting of burner head 91, can bypass the combustion chamber and enter the space 11 directly.

The aspiration of the combustion air via inlet 91*f* is effected by the rotation of evaporator 1 which also carries a set of impeller blades 14 deviating some of that air into the heat store 9 even in the position of FIG. 1 in which the entrance port 93*a* is closed by a plug 94*a* on a stem 94*b* of a valve 94. The latter valve confronts a port 11*a* through which exhaust gases from space 11 can escape into the atmosphere via an outlet 64 of casing 6. The same outlet serves for the discharge of spent cooling air which enters the casing at an intake port 35 and traverses the condenser 3.

The containers 93 of heat store 9 are provided with grooves accommodating electric resistance heaters 93*b* which may be energized in advance to precharge the storage unit, i.e. to melt the fusible substance in these receptacles. The superinsulation of walls 95 and 96 minimizes heat losses on standstill. In operation, with the system in the position of FIG. 1 and with the air/fuel mixture ignited by a single energization of a nonillustrated spark plug, the working fluid in tubes 12 is vaporized by the heated combustion gases from channel 11; a small part of these gases, bypassing the evaporator 1 so as not to undergo any appreciable cooling, is directed by the vanes 14 into the store 9 through which it circulates, re-entering the channel 11 through the partly obstructed gap 93*e*. This circulating air stream mingles with the fresh combustion gases and does not abstract any heat therefrom once the store 9 has been fully charged.

In the alternate position of FIG. 2, exhaust port 11*a* is blocked by the valve 94 while the entrance port 93*a* of heat store 9 is open. The exit 93*e* of this store is opened wide by the leftward shift of burner head 91; the air supply to the burner is cut off at 92 (see FIG. 1), along with the fuel supply to nozzle 91*a*. Evaporator 1 and fan blades 14 now circulate the entire air volume of channel 11 through the passages 93*d*, as indicated by arrows 93*c*, to extract from containers 93 the thermal energy necessary for vaporizing the working fluid traversing the engine 2. When conditions permit, the burner 91, 91*a* is reactivated with restoration of the position of FIG. 1.

The switchover between the positions of FIGS. 1 and 2 can be carried out under the direct manual control of the driver, or with the aid of a programmer as more fully described in my aforementioned application Ser. No. 396,520. There may also be a third switching position in which the heat store 9 and the burner 91, 91*a* are connected in tandem so that the air entering the combustion chamber 91*a* is preheated for an approximately 50% higher yield of thermal energy without disturbing the stoichiometric balance existing in the wide-open position of valve 92. Furthermore, the programmer may be made effective to alternate between the positions of FIGS. 1 and 2 (with reignition of the air/fuel mixture upon any return to the fuel-burning position of FIG. 1) under conditions of partial loading, in which case the valve 92 no longer operates as an adjustable throttle but merely has an on/off function.

The planetary-gear transmission 7 introduces a step-down ratio between the rotor-driven shaft 21 and the load, here specifically the traction wheels of the vehicle, which allows the engine rotor to turn at a considerably higher absolute speed than the counterrotating stator which is rigid with housing 4 and with the heat exchanger 1, 3 mounted thereon. The relatively slow rotation of unit 1, 3, 4 is sufficient to draw hot air from combustion chamber 91*b* or from heat store 9 axially into the evaporator 1, for substantially radial expulsion past the tubes 12, and to circulate cooling air in a similar manner through the condenser 3 past the tubes 31. With selective throttling of the air intake at 91*f*, and/or of the fuel supply to burner 91*a*, the delivery of thermal energy to the evaporator may be controlled by the driver to vary the speed of the vehicle under different load conditions. At high loads, e.g. upon the starting of the vehicle from standstill, the low absolute speed of the magnetically coupled shafts 21 and 81 results in a higher speed of the counterrotating unit 1, 3, 4 whereby the heat-exchanging effect of evaporator 1 is enhanced and evaporation of the working fluid (e.g. cesium, sodium or potassium) is intensified. Thus, the system of my invention automatically adjusts itself to varying load conditions and delivers the full engine torque even at low and zero speeds, thereby eliminating the need for the usual torque converter.

Figure 3:
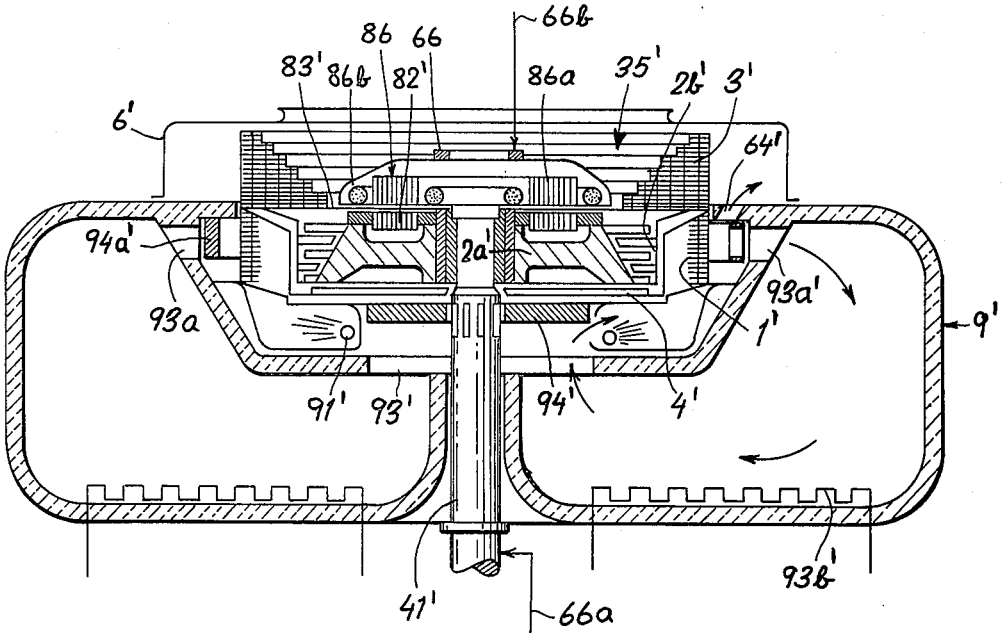
FIG. 3 is an axial sectional view of another power plant according to my invention.

FIG. 3 shows details of a power plant generally similar to that of FIGS. 1 and 2 in which the heat store 9 has been replaced by a unit 9' of toroidal configuration coaxial with heat-exchanger sections 1' and 3'; the containers for the active mass of this unit have not been illustrated, but resistors for thermally charging it have been shown at 93*b'*. An annular burner 91', centered on the axis of the rotating unit, is mounted in a combustion chamber between the rotating housing 4' of that unit and the heat store 9'. The combustion gases are exhausted by way of evaporator 1' and one or more ports 64' which open into a stationary casing 6' surrounding the condenser 3'; the condenser air enters the casing at 35' and leaves it, together with the exhaust gases, by a nonillustrated outlet.

The engine of the power plant shown in FIG. 3 is a turbine with a rotor 2*a'* and a stator 2*b'*, the latter being rigid with housing 4'. The rotor 2*a'*, journaled on an inward extension of housing shaft 41', carries an annular array of magnet poles 82' coacting, through a magnetically pervious housing wall 83', with an armature 86*a* of a field winding 86*b* of an electric-current generator 86 whose output drives the traction wheels of a vehicle or some other load to be powered by the system. The output voltage of generator 86 is developed across a pair of leads 66*a*, 66*b* contacting the shaft 41' and an insulated slip ring 66 on the generator casing.

The circulation of combustion air through the storage unit is regulated by an axially shiftable disk 94', overlying a central exit port 93', and by a rotatable ring 94*a'* having apertures alignable with respective entrance ports 93*a'*. The axial displacement of disk 94' and the rotation of the ring 94*a'* about the axis is controlled by nonillustrated linkages or servomotors.

Armature 86*a* and field winding 86*b* may be mounted on the relatively slow-moving housing shaft 41', as illustrated, but could also be held against rotation by a suitable connection (not shown) with the stationary frame carrying the heat store 9'. Particularly in the latter case, the armature may be provided with axially extending nozzles training a stream of compressed air upon housing wall 83' to prevent contact between that wall and the stationary elements of generator 86.

Figure 4:
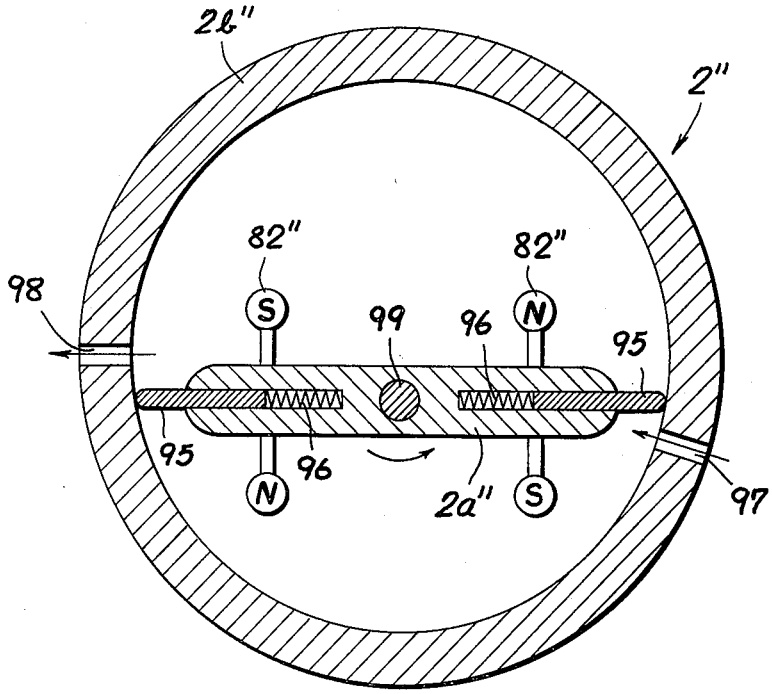
FIG. 4 is a cross-sectional view of a modified engine adapted to be used in the system of FIGS. 1 and 2 or in that of FIG. 3.

FIG. 4 shows another rotary engine which may be used for the prime mover 2 of FIGS. 1 and 2 or may be substituted for the turbine 2*a'*, 2*b'* of FIG. 3. This engine comprises a rotary displacement motor 2'' with a rotary piston 2*a''* eccentrically mounted on an axle 99 in a cylindrical stator or housing 2*b''*. The ends of piston 2*a''* carry a pair of radially slidable vanes 95, urged outwardly by springs 96 against the inner peripheral housing wall, which divide the interior of the housing into two compartments pressurized through a port 97 and vented through a port 98, respectively. Ports 97 and 98 communicate with the closed working-fluid circuit including a rotary heat exchanger, not shown, rigid with housing 2*b''* and mounted for joint rotation therewith on a common axis offset from that of axle 99. Piston 2*a''* carries an array of magnet poles 82'' which, through a magnetically pervious end wall of housing 2*b''*, excite an external generator armature on the housing or on a stationary support in the manner described above with reference to FIG. 3. Two such motors can be connected in tandem as part of the engine, with a common housing transversely subdivided into a pair of rotor chambers and with their pistons interconnected for joint rotation through axle 99 (which does not penetrate the housing walls) and disposed at right angles to each other.

It will thus be seen that I have disclosed a power plant in which two relatively movable members, mounted on a stationary frame for rotation in opposite directions, develop balanced torques which in most instances — in view of the unequal distribution of the effective masses of these members — lead to a rotor speed substantially higher than the stator speed. Since the stator rotation is needed mainly to drive cooling fluid such as ambient air through the condenser section of the rotating heat exchanger, all but a small fraction of the available kinetic energy can be used for driving the load.

I claim:

1. A power plant comprising:

a supporting frame;

an engine adapted to be driven by vapors of a vaporizable working fluid, said engine having a sealed housing and two relatively movable members mounted in said housing for rotation in opposite directions relative to said housing, solely by the pressure of the expanding working fluid, with mutually balanced torques;

heat-exchanger means connected with one of said members for rotation therewith, said heat-exchanger means including an evaporator upstream of said engine and a condenser downstream of said engine in a relatively hot and a relatively cold environment, respectively;

transmission means coupling the other of said members to a load to be driven; and conduit means including said housing for conducting said working fluid in a closed circuit through said engine and said heat-exchanger means for thermal interaction with said environments in said evaporator and said condenser.

2. A power plant as defined in claim 1 wherein the effective masses of said members are correlated to make the absolute speed of said other of said members substantially higher than that of said one of said members.

3. A power plant as defined in claim 2 wherein said transmission means has a step-down ratio substantially reducing the speed of said load with reference to that of said other of said members.

4. A power plant as defined in claim 3 wherein said housing is secured to said one of said members for joint rotation, said housing being provided with a magnetically pervious wall, said transmission means comprising magnetic-flux-generating means on one side of said wall and magnetic-flux-responsive means on the other side of said wall.

5. A power plant as defined in claim 4 wherein said magnetic-flux-generating means is disposed inside said housing and mechanically connected with said other of said members, said magnetic-flux-responsive means comprising an armature winding of an electric-current generator disposed outside said housing.

6. A power plant as defined in claim 3 wherein said transmission means includes a planetary-gear drive.

7. A power plant as defined in claim 1 wherein said one of said members is a piston cylinder, said other of said members being a rotary piston in said cylinder.

8. A power plant as defined in claim 1 wherein said evaporator, said condenser and said engine are centered on a common axis.

9. A power plant as defined in claim 8, further comprising a source of hot air opening axially into said evaporator to generate a substantially radial heating flow through the latter, said condenser being axially open to the atmosphere for penetration by a substantially radial cooling flow.

10. A power plant as defined in claim 9 wherein said source comprises a combustion chamber, heat-storage means and switchover means for alternately drawing said heating flow from said combustion chamber and from said heat-storage means.

* * * * *